United States Patent [19]

Fischer et al.

[11] Patent Number: 4,494,470

[45] Date of Patent: Jan. 22, 1985

[54] METHOD FOR IDENTIFYING SIZE AND/OR TYPE OF WORKPIECE RECEIVING MEANS AND SEWING APPARATUS FOR CARRYING OUT SAID METHOD

[75] Inventors: Jochen Fischer, Detmold; Hans Scholl, Oerlinghausen-Lipperreihe, both of Fed. Rep. of Germany

[73] Assignee: Kochs Adler AG, Bielefeld, Fed. Rep. of Germany

[21] Appl. No.: 485,591

[22] Filed: Apr. 18, 1983

[30] Foreign Application Priority Data

May 3, 1982 [DE] Fed. Rep. of Germany ..... 3216528

[51] Int. Cl.[3] ..... D05B 21/00

[52] U.S. Cl. ..... 112/121.12; 112/121.14; 112/121.15; 112/262.1

[58] Field of Search ..... 112/121.12, 121.15, 112/121.11, 121.14, 102, 103, 2, 262.1, 262.3

[56] References Cited

U.S. PATENT DOCUMENTS

| | | | |
|---|---|---|---|
| 4,006,698 | 2/1977 | Scholl et al. | 112/121.14 X |
| 4,312,283 | 1/1982 | Fischer et al. | 112/121.12 |
| 4,455,952 | 6/1984 | Morin | 112/121.12 |

*Primary Examiner*—Peter Nerbun

*Attorney, Agent, or Firm*—Max Fogiel

[57] ABSTRACT

An arrangement increasing the rate of production and operating reliability of a method for identifying the type and/or size of a work receiving unit applied to an automatic sewing device. The identifying procedure is carried out prior to the sewing operation. According to the invention a sensor is associated with the sewing head or with the lower arm and provides a signal when coinciding with a mark at the work receiving unit. The sensor is first moved along a straight line in X-direction and then along a straight line in Y-direction. The straight lines each include a mark, one of which represents type of the work receiving unit and the other one the size of the same.

12 Claims, 7 Drawing Figures

Fig. 1
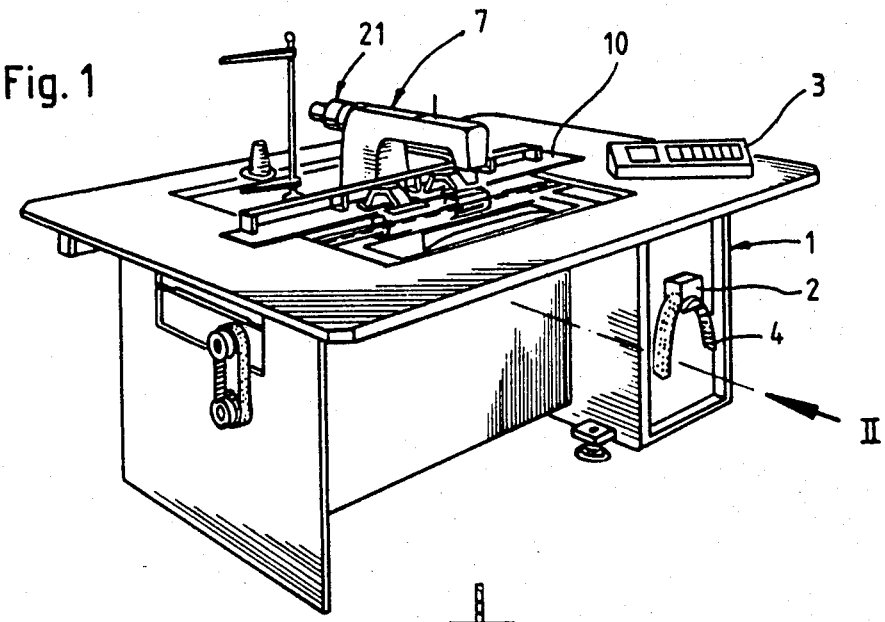
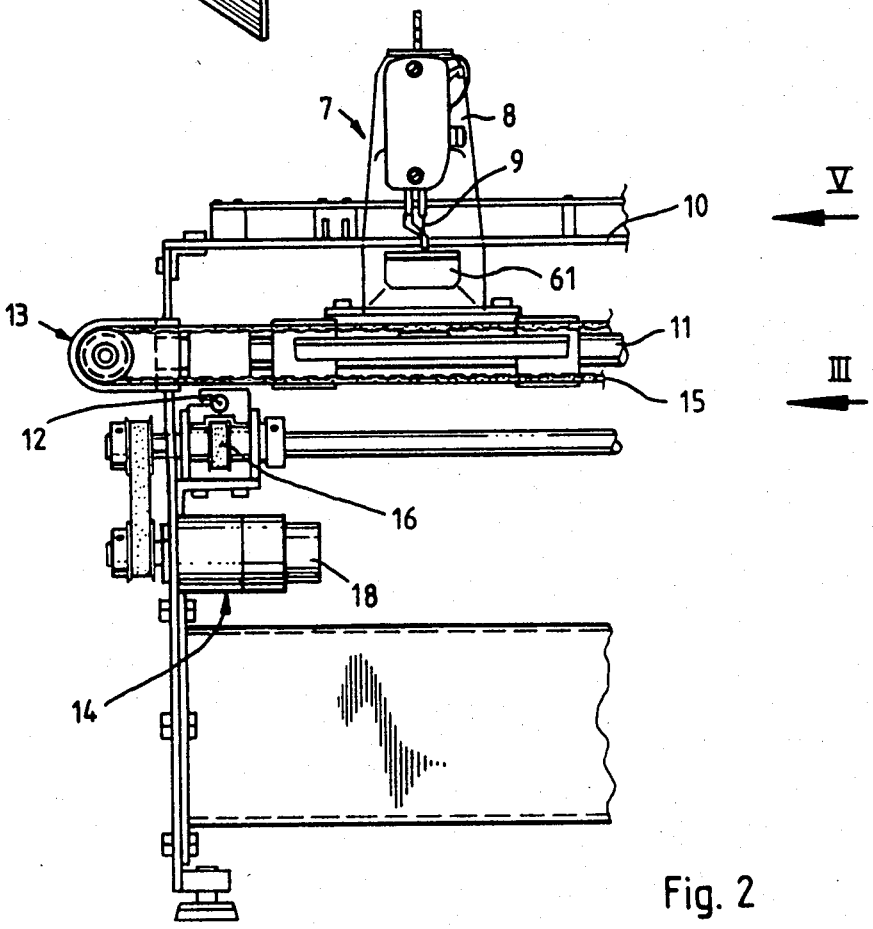
Fig. 2

+X
+Y
VII
D
E
F

METHOD FOR IDENTIFYING SIZE AND/OR TYPE OF WORKPIECE RECEIVING MEANS AND SEWING APPARATUS FOR CARRYING OUT SAID METHOD

BACKGROUND OF THE INVENTION

The present invention relates to an automatic sewing machine, in which relative movement in a workpiece and a sewing head is controlled by a computer receiving a program according to a predetermined contour to be stitched. In particular, the present invention relates to a method and device for increasing the rate of production and the reliability for operating such sewing machines.

In such CNC-controlled sewing automats an individual sewing contour is given by a program stored on a data carrier, e.g. a punched tape or an EPROM-cassette into the computer. The contour represents the path of the needle with respect to the workpiece. The contour is determined by perpendicular coordinates of some significant points, which form the variables of an algorithm applied for figuring all required values of a contour by using linear or square interpolation. Thus, by the input of such siginificant points the basic profile of the contour is determined. Furthermore, it is required that the workpiece clamp is formed with a profile that is matched to the contour controlled by the computer. In case of implementing a workpiece clamp that does not fit to the programmed contour, the sewing head of the sewing automat or the workpiece clamp and, under particular circumstances, the drive motors will be damaged. Therefore, it is necessary to check the matching of an inserted workpiece clamp with the computer-controlled contour prior to initiating a sewing process. As this checking procedure should be performed in a minimum of time, on one hand, and since misoperation on the other hand must be eliminated, it has proved necessary to automatically perform this control procedure prior to the sewing process and to carry out this control without action from the operator.

Moreover, besides the input of the significant points determining the basic profile of the contour, the algorithm considers a further variable corresponding to a size adjustment of the workpiece clamp. The workpiece clamp is formed for a size adjustment so that a left and a right half of the workpiece clamp is relatively adjustable to each other and in parallel to one coordinate axis. Due to this adjustment the program put into the computer must be modified correspondingly. As the size adjustment depends on the actual size of the workpiece, a stepless adjustment is desired to a great extent so that it is required to correspondingly alter the input of size information for the computer in a stepless manner.

In a known automatic sewing machine there are four microswitches provided which cooperate with exchangeably contoured workpiece clamps. After the installation of a certain workpiece clamp a characterizing shift status is indicated by the switches which are being read and compared by the computer with the loaded program. Only after this checking procedure can the sewing process be initiated as far as both the loaded program and the workpiece clamp show an associated contour. Indeed, by this known application of a number of switches for identifying a workpiece clamp, damaging of the sewing machine caused by mis-operation is eliminated. However, it is necessary to install a plurality of switches including wiring, which is costly. Due to the physical extension of such switches the number of identification codes is limited to the number of sixteen, for four switches.

From the German laid-open document No. 29 38 064 or the corresponding U.S. Pat. No. 4,312,283 there is known a sewing machine installed with a workpiece receiving device composed of two parts which are adjustably arranged with respect to each other for receiving workpieces of different sizes. According to this publication the computer controlling the sewing machine is operably connected to a stepless working encoder connected to the both parts of the workpiece clamp so as to transmit corresponding electrical information in an automatic manner to the computer. Such an encoder, which is connected by means of a rack and pinion to the two size-adjustable parts of the workpiece clamp, is expensive and limited with respect to reliable operation. Furthermore, under particular circumstances, the zero setting of such an encoder is required prior to the operation of the automatic sewing machine.

It is therefore the main object of the present invention to provide a method for assuring safe operation of an automatic sewing device with simultaneous increase in the production rate.

Another object of this invention is to provide a method of the aforesaid kind, in which already-existing components are employed for a checking procedure.

Still another object of this invention is to provide a method with a large number of codes for identification.

A further object of the present invention is to provide sewing apparatus for carrying out the afore-described method using a reduced number of components, thereby increasing reliability and reducing costs for manufacture.

Still a further object of this invention is to provide sewing apparatus of the aforesaid character, in which space consuming elements used for such a checking procedure are eliminated.

SUMMARY OF THE INVENTION

The objects of the present invention are achieved by carrying out a controlled relative movement between a sewing head and a workpiece clamp in parallel to the X- and Y- axis of a coordinate system. Predetermined distances limited by a firm reference point of the coordinate system and a trigger point sensed by a sensor at the sewing head, represent coded information employed by the control for a checking procedure automatically carried out prior to the start of a sewing operation. The use of already existing digital encoders operating with a high resolution offer a volume of identification codes which exceeds the requirements to a great extent.

With the method according to the present invention, information on the manually adjusted workpiece size can be fed into the computer for assuring matched sewing and clamp contours, or information about the type of the installed workpiece clamp can be fed into the computer so as to carry out a comparison or to modify the program accordingly. The special advantage of the method according to the present invention is presented by carrying out a checking procedure subdivided into two coordinate directions, whereby the speed of operation as well as reliability of such sewing apparatus is considerably increased.

A further advantage is achieved by moving the sewing head into a resting position arranged at a distance away from the mounting base of the workpiece clamp, thus facilitating an exchange of workpiece clamps and even the installation of larger dimensioned workpiece clamps.

Furthermore, it is advantageous to place the line at first traced by the sewing head, in the range of the mounting base of the workpiece clamp in such a position, where workpiece clamps are equally formed regardless of their contour. On such a line different workpiece clamps can be marked clearly. According to the present invention the checking procedure is automatically controlled by the computer. The sewing head is finally moved into a position for starting the sewing operation. Thus, any influence of the operator is eliminated, on one hand, and, on the other hand, a size adjustment can be carried out in a reduced time.

With the arrangement of the sensor in the lower arm of the sewing head, according to the proposed sewing apparatus, an obstruction in the operation and in service activities within range of the needle is eliminated. The embodiment of a code of a V-shaped groove combined with a bolt represents a solid construction, so that it is not necessary in this regard, to carefully handle the workpiece clamps at the exchange or at the storage, respectively.

Other objects, advantages and features of the present invention will appear from the detailed description of the preferred embodiment which will now be explained in connection with the accompanying drawings.

BRIEF DESCRIPTION OF THE DRAWINGS

FIG. 1 is a perspective total view of an automatic sewing machine;

FIG. 2 is a partial front plan view of the automatic sewing machine in the direction of the arrow II in FIG. 1;

DESCRIPTION OF A PREFERRED EMBODIMENT

Figure 3:
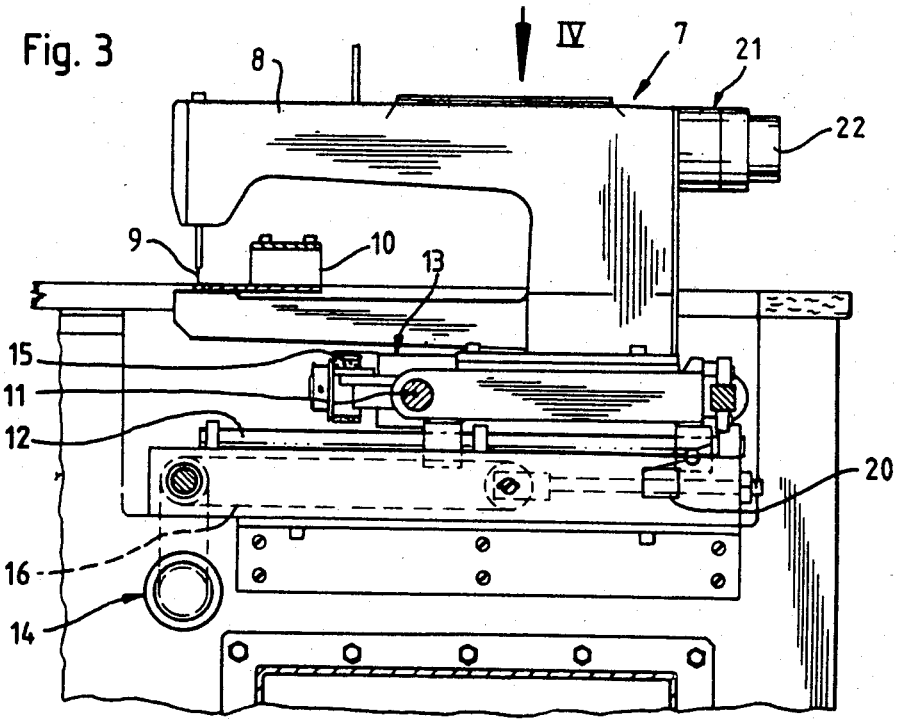
FIG. 3 is a partial side view of the automatic sewing machine in the direction of the arrow III in FIG. 2.

The automatic sewing machine according to FIG. 1 is controlled by a computer 1 having a tape reader 2. The functions of the computer 1 are manually released by means of a control panel 3. Prior to a sewing cycle, the tape reader 2 is loaded with a tape 4 having coded information, which is read into the computer 1 as soon as the command is inserted into the panel 3.

Besides coded information for a workpiece receiving device 5 which receives a workpiece 6, the tape 4 carries information about significant points defining a sewing contour to be controlled. For the seam to be produced, these significant points are fed into the computer 1 as X- X-coordinates, which represent parameters for the algorithm of computation, in order to calculate the remaining points of the contour by applying linear or square interpolation. Moreover, information of special points of the contour are read into the computer 1 as, for example, the corners of collar tips, so that, after reaching such significant points, the computer logic is capable of branching the program for considering the complicated control operation adjacent to these points. Furthermore, the tape 4 delivers information to the computer 1 for which, at sections of the contour, additionally offered parameters have to be considered. These parameters are considered by the computer 1 in the contour sections as provided by the tape 4.

Figure 4:
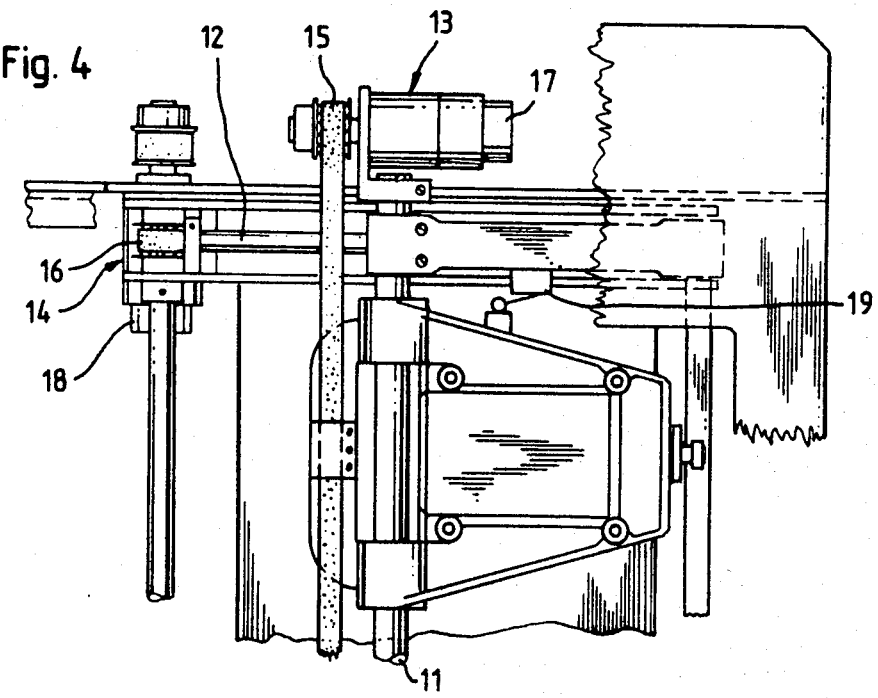
FIG. 4 is a partial top plan view of the automatic sewing machine in the direction of the arrow IV in FIG. 3, without, however, the, sewing head.
Figure 5:
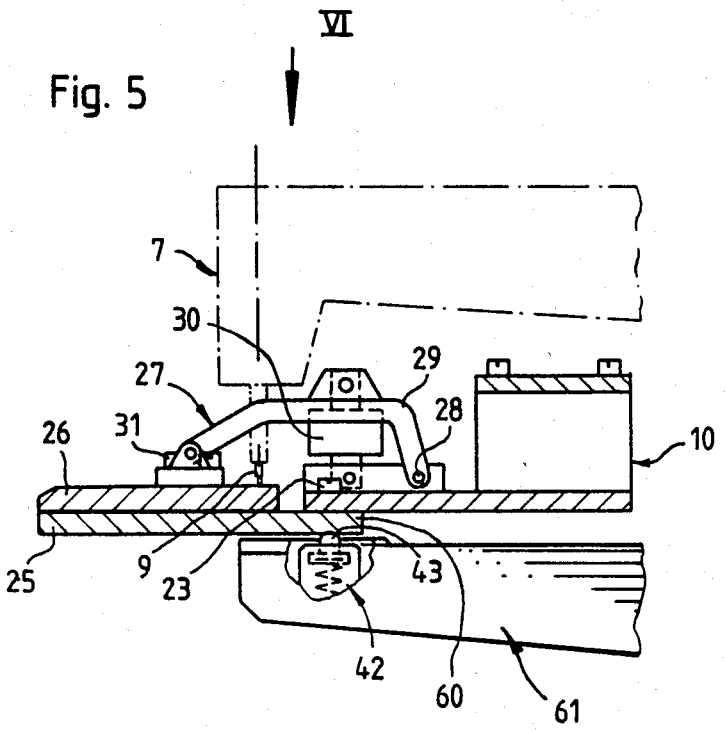
FIG. 5 is a sectional view in the direction of the arrow V in FIG. 2.

The automatic sewing machine according to FIG. 1 installed with a workpiece receiving device 5 for a workpiece 6 is provided for producing shirt collars of different sizes. A sewing head 7 defining a part of a sewing machine 8 carries a needle 9 (FIGS. 2 and 3). The workpiece receiving device 5 is secured to a stationary bracket 10. A relative motion between the needle 9 and the workpiece 6 in a perpendicular plane with respect to the needle motion is obtained by the fact that the sewing machine 8 is movable by two guide bars 11 (X-direction) and 12 (Y-direction) which are horizontal and perpendicular to each other (FIGS. 2, 3 and 4). This movement is performed by associated servo motors 13, 14 via timing belts 15, 16.

The servo motors 13, 14 are equipped with encoders 17, 18 (FIGS. 2 and 4), which, prior to operation are calibrated by switches 19, 20, indicating the position of the needle 9 relative to the stationary workpiece receiving device 5 in X-and Y-direction. The computer 1 controls the servo motors 13, 14, so that, when the needle 9 penetrates the workpiece 6, the position of the sewing machine 8 corresponds to a position preset by the computer 1.

In order that the computer 1 obtains information about the vertical position of the needle 9, the sewing machine 8 is provided with a sewing head drive 21 including an encoder 22 (FIG. 3), which provides a zero pulse at each needle stroke informing the computer 1, at any time, about the position of the needle 9. The sewing head drive 21 is also controlled by the computer 1, so that, also when sewing difficult seam contours having acute angled passages (i.e. collar tips), the needle 9 stitches only into the points of the desired contour and not into such points which may occur at such critical areas of the contour caused by overswinging of the sewing machine 8, which is moved in X-Y-direction.

With respect to a line 34 the workpiece receiving device 5 consists of two symmetrical halves 5*a* and 5*b*. Each of the halves is provided with a supporting plate 25 connected by screws 23 and pins 24, respectively, to each slide plate 35 of the stationary bracket 10. The workpiece 6 is clamped upon the supporting plate 25 by a clamping plate 26, the shape of which corresponds with that of the supporting plate and the workpiece 6. Two clamping devices 27 each comprising a lever 29 rotatable about a bolt 28, effect the clamping plates to be clamped. Between the lever 29 and the stationary bracket 10 there is located an air cylinder 30 delivering the pressing force. Each clamping plate 26 is connected to the lever 29 via a swivel bearing 31, which is secured to the clamping plate 26 by screws 32 and pins 33.

Each slide plate 35 is formed with two slots 36 extending in parallel to each other and into which engage connecting sleeves 37 secured to the stationary bracket 10. This ensures the slide plates 35 to be secured to the stationary bracket 10 in such a manner, that the slide plates 35 are adjustable in X-direction, so that, for instance, the neck portion of the shirt collar to be sewn will become longer or shorter. Adjustment of the slide plates 35 is made by means of the lever 38, which is rotatably supported at the line 34 in Y-direction and hinged to two further levers 39 arranged above and below its axis of rotation. The levers 39 are hingedly connected to each slide plate 35. The angle position of the lever 38 and thus the distance between the slide plates 35 and the halves 5*a*, 5*b* of the workpiece receiving device 5 is lockable by means of a toggle 40. A microswitch may be associated to this locking device for preventing, at a loosened toggle 40, an initiating of a sewing cycle and for causing the sewing head 7 to be moved into its lateral initial position.

To the upper surface of the lower arm 61 there is arranged a sensor 42 formed as a microswitch. The sensor 42 includes a semi-circular switch knob 43, which is spring-loaded away from the lower arm 61.

The supporting plate 25 of each half 5*a* and 5*b* of the workpiece receiving device 5 is provided with an extension 44, in which, in Y-direction, there is formed a V-shaped groove 45 for receiving a bolt 46.

The switch knob 43 rests against the tension of a spring against the lower surface 47 of the extension 44 causing the switch knob 43 to be pressed into the groove 45 when positioned above the latter during the movement of the sensor 42 in X-direction. During the movement in Y-direction, the switch knob 43, when reaching the bolt 46 in alignment with the lower surface 47, is again pressed into its initial position. The engaged and disengaged positions of the switch knob 43 correspond to a switch condition On-Off or reverse, or to a signal 10 or 1 respectively.

The electronic circuit not shown in detail is formed so as to provide a signal to the computer 1 when the switch condition 0-1 or 1-0 changes.

The checking procedure prior to the sewing operation is as follows:

After switching on the sewing machine 8, the sewing head 7 and the lower arm 61, respectively, are moved so that the sensor 42 is located above the reference point 48. The slide plates 35 are locked by means of the toggle 40. By actuation of a push button (not shown) on the control panel 3, the sewing head 7 controlled by the computer 1 is moved in Y-direction until the sensor 42 has reached the starting point 49 of a first straight line 50. The first straight line 50 extends in the direction of the X-coordinate through the extension 44 of the workpiece receiving device 5. In the area of the mounting base 60 the extension 44 is always formed equally with respect to workpiece receiving devices 5 of different kinds as a consequence of the bores for receiving the screws 23 and the pins 24 which have to be located always in the same position.

After reaching of the straight line 50, the sewing head 7 is moved in +X-direction until the sensor 42 reaches and engages the groove 45. This causes a change of the switch condition 0-1 and a signal is provided to the computer 1, by means of which the computer forms a size identification signal. The size is defined by the step width E extending from the starting point 49 in X-direction to the groove 45, i.e. the number of pulses provided by the encoder 17 of the servo motor 13. Depending on the program, this signal may be used for giving the code information to the computer for producing a seam according to the manually adjusted size, or for enabling the computer to compare between a pre-programmed size value and a really adjusted size.

A second straight line 51 extending in Y-direction is given by the center line of the groove 45. After reaching this second straight line 51 or the groove 45 and the output of the first signal, the sewing head 7 and the lower arm 61, respectively are moved in +Y-direction until the switch knob 43 of the sensor 42 reaches the bolt 46. The bolt 46 is provided with a circular chamfer 52 so that the switch knob 43 may be smoothly brought into the engaged position. This relates to a change-over switching of 1-0, at which again a signal is provided. This signal facilitates the computer 1 to form a type identification of the workpiece receiving device defined by the step width corresponding to the distance D between the straight line 50 and the bolt 46, and to determine prior to the sewing cycle, whether the programmed seam contour corresponds with the contour of the used workpiece receiving device 5 or not. Consequently, different workpiece receiving devices 5 are identified each by the Y-position of the bolt 46 and the signal produced by the number of pulses provided by the encoder 18 of the servo motor 14.

The afore-mentioned description shows that, with the aid of the automatic sewing machine and the method according to the invention, control is possible with respect to the size adjustment and the type used for the workpiece receiving device 5. At that, the starting point 49 is located beyond the occurring maximum size adjustment remote from the symmetrical line 34 by the distance F. For fine identification of only one code size, on principle, it is also possible to use the great number of resolved points located in the surface D×E.

After finishing this checking procedure, and by further actuation of the knob, the sewing head 7 is moved so that the needle 9 of the sewing head 7 is located at the left starting point. By a still further actuation of the knob, the sewing head 7 is moved to the seam starting point 54 and begins to sew the seam 55. A microswitch (not shown) may ensure that while producing the seam, no size adjustment of the workpiece receiving device 5 may be carried out. A size adjustment may only be carried out when the sewing head 7 has reached the starting point 56 or 53, which defines the starting point for the subsequent sewing cycle. Subsequently, the seam starting point 57 or 54 is started.

A size adjustment may be performed after reaching the left starting point 53 or the right starting point 56. After loosening the toggle 40, the sewing head 7 controlled by the computer 1, is moved to one of the outer zero points 58 or 59. The tape 4 includes the required positioning information. After performing a size adjustment and relocking the toggle 40, the checking procedure begins from the right side of FIG. 6 with the aid of the elements provided on the half 5*b* of the workpiece receiving device 5 and in full compliance with the above description. The elements are symmetrically arranged with respect to those of the half 5*a*.

Figures 6, 7:
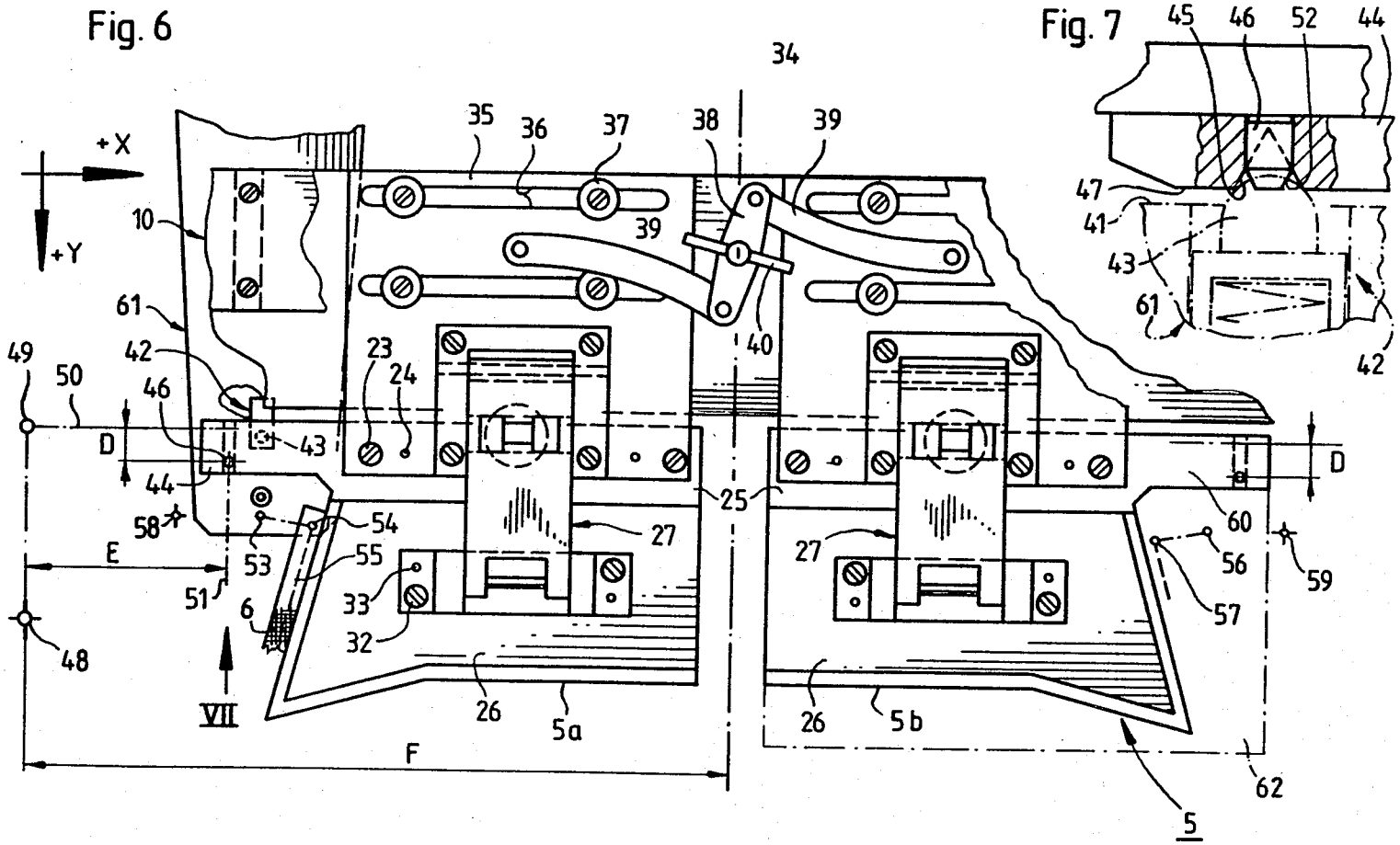
FIG. 6 is a partial top plan view in the direction of the arrow VI in FIG. 5.
FIG. 7 is a partial sectional view of the sensor area in the direction of the arrow VII in FIG. 6.

The different clamping plate types are produced from semi-manufactured components 62, the original contour of which is dot-dash-lined in FIG. 6 and which are already provided with the bores for receiving the pins 24 and the screws 23. The sandwich-like positioned halves 5*a* and 5*b* may be milled together. At the same time, in conjunction with this procedure, also the groove 45 may be preformed and the bolt 46 may be set.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. Method of identifying the type and/or size of a workpiece receiving device, which can be adjusted in size in a coordinate direction and is inserted in an automatic sewing machine before the beginning of a sewing process comprising the steps of: a plane relative movement between a sewing head or a lower arm and a workpiece by computerized servo motors driven in two mutually perpendicular directions; indicating with a signal that a programmed workpiece receiving device matches a device actually being used and initiating the sewing process upon release, supplying said signal to a computer; moving a sensor assigned to the sewing head or lower arm under computer control from a starting point in the sewing plane along a first straight line that extends over the mounting base of the workpiece receiving device and relative to it in a first coordinate direction; detecting with the sensor a mark at a signal-release point on the line and releasing a signal to the computer; processing with the computer a signal corresponding to the distance traveled up to that time along the line, as a parameter for the adjusted size of the workpiece receiving device; moving the sensor subsequently from a starting point in the sewing plane along a second straight line extending over the mounting base of the workpiece receiving device; detecting another mark at a signal-release point on the second line and releasing a signal to the computer; comparing thereupon with the computer the signal corresponding to the distance traveled up to that time along the second line, as a parameter for the workpiece receiving device being used, with the previously programmed parameter.

2. Method as defined in claim 1, wherein the sewing head or lower arm travels as the result of a triggering signal from a reference point outside the first straight line to the starting point on the first straight line.

3. Method as defined in claim 1, wherein once the computer has processed and confirmed the first and second parameter signals, the sewing head travels, as the result of a signal that is entered, to a program-initiation point and, as the result of another signal that is entered, to a seam starting point, but with no sewing taking place.

4. Method as defined in claim 1, wherein the first signal is constructed out of the alteration from 0 to 1 and the second signal is constructed out of the alteration from 1 to 0 in the signal emitted from the sensor.

5. Method as defined in claim 1, wherein the sewing head automatically travels to an external starting point when the device that adjusts the size of the sewing head is released.

6. Apparatus for identifying the type and/or size of a workpiece receiving device which can be adjusted in size in a coordinate direction and is inserted in an automatic sewing machine before the beginning of a sewing process, comprising: two computerized servo motors for two mutually perpendicular coordinate directions to generate a programmed relative movement between a sewing head and a workpiece in a plane substantially perpendicular to the direction in which the sewing needle moves; an interchangeable workpiece receiving device adjustable in size in one coordinate direction and assigned to the seam to be sewn; means for generating at the computer a signal identifying the particular workpiece receiving device being employed; a sensor assigned to the sewing head or lower arm; a first and second triggering means for activating the sensor and assigned to the workpiece receiving device, said sensor releasing a signal to the computer when the sensor and the first triggering means meet while the sewing head is traveling along a first coordinate direction relative to the workpiece receiving device, and when the sensor and the second triggering device meet while the sewing head is traveling along a second coordinate direction relative to the workpiece receiving device.

7. Apparatus as defined in claim 6, wherein said sensor is mounted in a lower arm of the sewing machine.

8. Apparatus as defined in claim 6, wherein said sensor is a microswitch.

9. Apparatus as defined in claim 8, wherein said microswitch has a substantially hemispherical spring-loaded switch knob.

10. Apparatus as defined in claim 6, wherein said first triggering means comprises a groove.

11. Apparatus as defined in claim 10, wherein said groove has a V-shaped cross-section.

12. Apparatus as defined in claim 10, wherein said second triggering means comprises a bolt that fits into said groove.

* * * * *